US012215688B2

(12) United States Patent
Moreno et al.

(10) Patent No.: US 12,215,688 B2
(45) Date of Patent: Feb. 4, 2025

(54) ELECTRONIC POSITIVE DISPLACEMENT FLUID PUMP AND METHOD OF ENCAPSULATING THE SAME

(71) Applicant: DELPHI TECHNOLOGIES IP LIMITED, St. Michael (BB)

(72) Inventors: Alejandro Moreno, El Paso, TX (US); Aldo Darien Venegas Carrillo, Juarez (MX); Salvador Plascencia Schaefer, Juarez (MX); Daniel J. Moreno, El Paso, TX (US); Raul Buendia, Juarez (MX)

(73) Assignee: PHINIA JERSEY HOLDINGS LLC, Wilmington, DE (US)

( * ) Notice: Subject to any disclaimer, the term of this patent is extended or adjusted under 35 U.S.C. 154(b) by 0 days.

(21) Appl. No.: 18/128,529

(22) Filed: Mar. 30, 2023

(65) Prior Publication Data

US 2024/0328413 A1 Oct. 3, 2024

(51) Int. Cl.
*F04C 2/10* (2006.01)

(52) U.S. Cl.
CPC ..... *F04C 2/10* (2013.01); *F04C 2230/60* (2013.01); *F04C 2240/30* (2013.01); *F04C 2240/40* (2013.01)

(58) Field of Classification Search
CPC ..... F04B 53/16; F04B 39/121; F04D 29/40–406; F04C 2240/30
See application file for complete search history.

(56) References Cited

U.S. PATENT DOCUMENTS 2,631,250 A * 3/1953 Parker ..... H02K 33/10 310/34
2,669,095 A * 2/1954 Bishofberger ..... F15B 15/18 417/418
2,716,381 A * 8/1955 Parker ..... F04B 17/046 417/552

(Continued)

FOREIGN PATENT DOCUMENTS

DE 4440238 A1 5/1995
EP 2796722 A1 10/2014
WO 2020126947 A1 6/2020

OTHER PUBLICATIONS

International Search Report of the International Searching Authority for PCT/US2024/020741, dated Jul. 22, 2024 (2 pages).

*Primary Examiner* — Thomas Fink
(74) *Attorney, Agent, or Firm* — Warner Norcross + Judd LLP

(57) ABSTRACT

A casing for a fluid pump is provided. The casing includes a unitary, single-piece, elongated shell having opposite first and second open ends. A circumferential bead is formed in the shell. A sleeve is received in the first open end of the shell. The sleeve is disposed between the bead and the first open end. A heat sink cap is received in the first open end and engages the sleeve. The shell includes a crimp formed at the first open end. The crimp contacts the heat sink cap and retains the heat sink cap in the first open end. The shell includes a lip formed at the second open end. A motor section and at least a part of a pumping section of the pump are encapsulated within the shell between the lip and the crimp. A fluid pump and a method of encapsulating the fluid pump are also provided.

17 Claims, 10 Drawing Sheets

(56) References Cited

U.S. PATENT DOCUMENTS

| | | | | | |
|---|---|---|---|---|---|
| 2,717,553 | A * | 9/1955 | Parker | F02B 1/00 | 417/44.9 |
| 3,754,844 | A * | 8/1973 | Nusser | F02M 37/08 | 310/43 |
| 3,849,029 | A * | 11/1974 | Creager | F04B 45/053 | 417/388 |
| 4,479,765 | A * | 10/1984 | Robertson | F01N 5/04 | 92/85 B |
| 4,571,159 | A * | 2/1986 | Beardmore | F02M 37/08 | 417/540 |
| 4,820,138 | A | 4/1989 | Bollinger | | |
| 5,129,796 | A * | 7/1992 | Emmert | F04D 29/606 | 417/423.5 |
| 5,221,183 | A * | 6/1993 | Hoeffken | F04D 29/4226 | 29/509 |
| 5,494,403 | A * | 2/1996 | Kobayashi | F04D 29/2266 | 415/102 |
| 2006/0039812 | A1* | 2/2006 | Agui | F16L 55/053 | 417/540 |
| 2007/0065314 | A1* | 3/2007 | Nagata | F04D 13/06 | 417/423.1 |
| 2008/0298985 | A1 | 12/2008 | Gettel et al. | | |
| 2014/0212272 | A1* | 7/2014 | Castillo | F04D 5/002 | 415/119 |
| 2019/0353169 | A1* | 11/2019 | Castillo | F04D 29/628 | |

* cited by examiner

ELECTRONIC POSITIVE DISPLACEMENT FLUID PUMP AND METHOD OF ENCAPSULATING THE SAME

FIELD OF THE INVENTION

The disclosure generally relates to positive displacement fluid pumps and, more specifically, to electronic positive displacement pumps for pumping fluids such as oil or fuel.

BACKGROUND OF THE INVENTION

Electro-hydraulic pumps are electromechanical apparatuses in which mechanical energy generated by a motor is transferred to a hydraulic pump section that moves a fluid to provide fluid flow and fluid pressure in a hydraulic circuit. Examples of these pumps used in vehicles include gear pumps such as electronic fuel pumps (EFPs) that feed fuel from the fuel delivery module (FDM) in the fuel tank to a combustion engine of the vehicle. Other examples include electronic oil pumps that move hydraulic fluid to cool and lubricate the internal mechanisms of, for example, an integrated drive module (IDM), such as the drive motor and gear box of the IDM. These electronic pumps may be directly commutated ("brush") pumps that are driven by a constant voltage signal or electronically commutated ("brushless") pumps that are driven by dedicated pump controllers. Common electronically commutated pumps include a housing assembly that houses the motor and a circuit board that operates the motor. A pumping section that is driven by the motor is also located in the housing. The pumping section may include, for example, an internal plate, a gerotor assembly that is disposed in the internal plate, and an external plate that closes the housing and includes inlet and outlet ports.

The use of electronically commutated pumps in the field of automotive vehicles has increased with the demand for greater vehicle fuel economy as well as greater drive range for electric vehicles (EVs). This demand requires that the pumps and systems that use them are more robust and efficient, while also offering these improvements at a lower cost. For example, the components of conventional pumps including the motor, pumping section, and housing are typically formed of cast aluminum and are bolted together to provide the required rigidity and axial retention load. However, bolted assemblies require space for the screws/bolts, threads, and bosses/inserts required to bolt the pump components together, and the bolting process has an inherent cost of the materials and assembly cycle time.

BRIEF SUMMARY

A casing for a fluid pump is provided. The casing includes a unitary, single-piece, elongated shell having opposite first and second open ends. A circumferential bead is formed in the shell. The bead includes a radial protrusion. A sleeve is received in the first open end of the shell. The sleeve is disposed between the bead and the first open end. A heat sink cap is received in the first open end and engages the sleeve. The shell includes a crimp formed at the first open end. The crimp contacts the heat sink cap and retains the heat sink cap in the first open end. The shell includes a lip formed at the second open end. The fluid pump includes a motor section and a pumping section, and the motor section and at least a part of the pumping section are encapsulated within the shell between the lip and the crimp.

In specific embodiments, the shell is formed of metal.

In specific embodiments, the shell is generally tubular in shape.

In specific embodiments, the casing further includes a housing having a cavity. The shell is received in the cavity, and the mounting ring is fastened onto the housing to secure the shell therein.

In particular embodiments, the casing includes an O-ring disposed around an outer surface of the shell adjacent the bead. The O-ring seals the casing between the cavity and the shell.

In specific embodiments, the heat sink cap is a circular disk.

An improved fluid pump is also provided. The fluid pump includes a motor section and a pumping section driven by the motor section. The fluid pump also includes a unitary, single-piece, elongated shell having opposite first and second open ends. A circumferential bead is formed in the shell. The bead includes a radial protrusion. A sleeve is received in the first open end of the shell. The sleeve is disposed between the bead and the first open end. A heat sink cap is received in the first open end and engages the sleeve. The shell includes a crimp formed at the first open end. The crimp contacts the heat sink cap and retains the heat sink cap in the first open end. The shell includes a lip formed at the second open end. The pumping section is disposed at least partially within the shell adjacent the lip. The motor section is disposed within the shell adjacent to the pumping section. A controller is disposed within the sleeve adjacent the heat sink cap.

In specific embodiments, the sleeve contacts the motor section.

In specific embodiments, the housing includes an inlet opening and an outlet opening.

In particular embodiments, the inlet opening and the outlet opening are arranged in an axial direction of the shell.

In particular embodiments, the inlet opening is arranged in an axial direction of the shell, and the outlet opening is arranged in a radial direction of the shell.

In specific embodiments, the pumping section includes a pumping ring sandwiched between an external plate and an internal plate.

In particular embodiments, the internal plate, the pumping ring, and the external plate are disposed within the shell, and the lip of the shell engages an outer face of the external plate.

In particular embodiments, the internal plate and pumping ring are disposed within the shell, the lip of the shell engages an outer face of the pumping ring, and the external plate is disposed outside of the shell adjacent the second open end of the shell.

In certain embodiments, an O-ring encircles a sidewall of the external plate.

A method of encapsulating a fluid pump is also provided. The method includes providing the casing as described above. The method further includes providing a fluid pump that includes a pumping section, a motor section, and a controller. The method further includes inserting at least a portion of the pumping section into the shell adjacent the lip of the shell. The method further includes inserting the motor section into the shell adjacent the pumping section. The method further includes inserting the controller within the sleeve in the first open end of the shell. The method further includes placing the heat sink cap on the sleeve adjacent the first open end of the shell. The method further includes crimping an edge of the first open end of the shell to form the crimp, wherein a load is exerted on the sleeve by the heat sink cap and transferred to the lip at the second open end of the shell via the motor section and the pumping section within the sleeve.

In specific embodiments, the casing further includes a mounting ring surrounding the bead of the shell, and a housing including a cavity. Additionally, the method further includes the steps of inserting the shell into the cavity of the housing, and fastening the mounting ring onto the housing to secure the shell therein.

DESCRIPTION OF THE DRAWINGS

Various advantages and aspects of this disclosure may be understood in view of the following detailed description when considered in connection with the accompanying drawings, wherein.

DETAILED DESCRIPTION OF THE INVENTION

Figure 1:
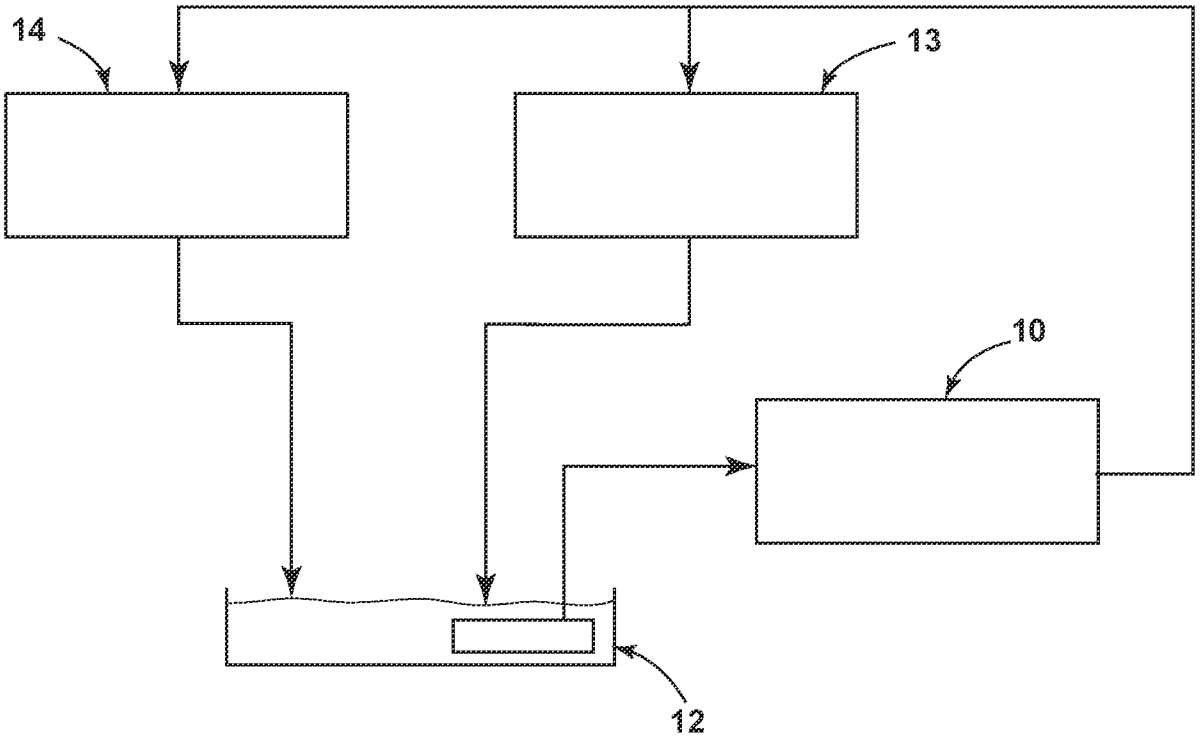
FIG. 1 is a schematic view of an integrated drive module including a positive displacement fluid pump in accordance with embodiments of the disclosure.
Figure 2:
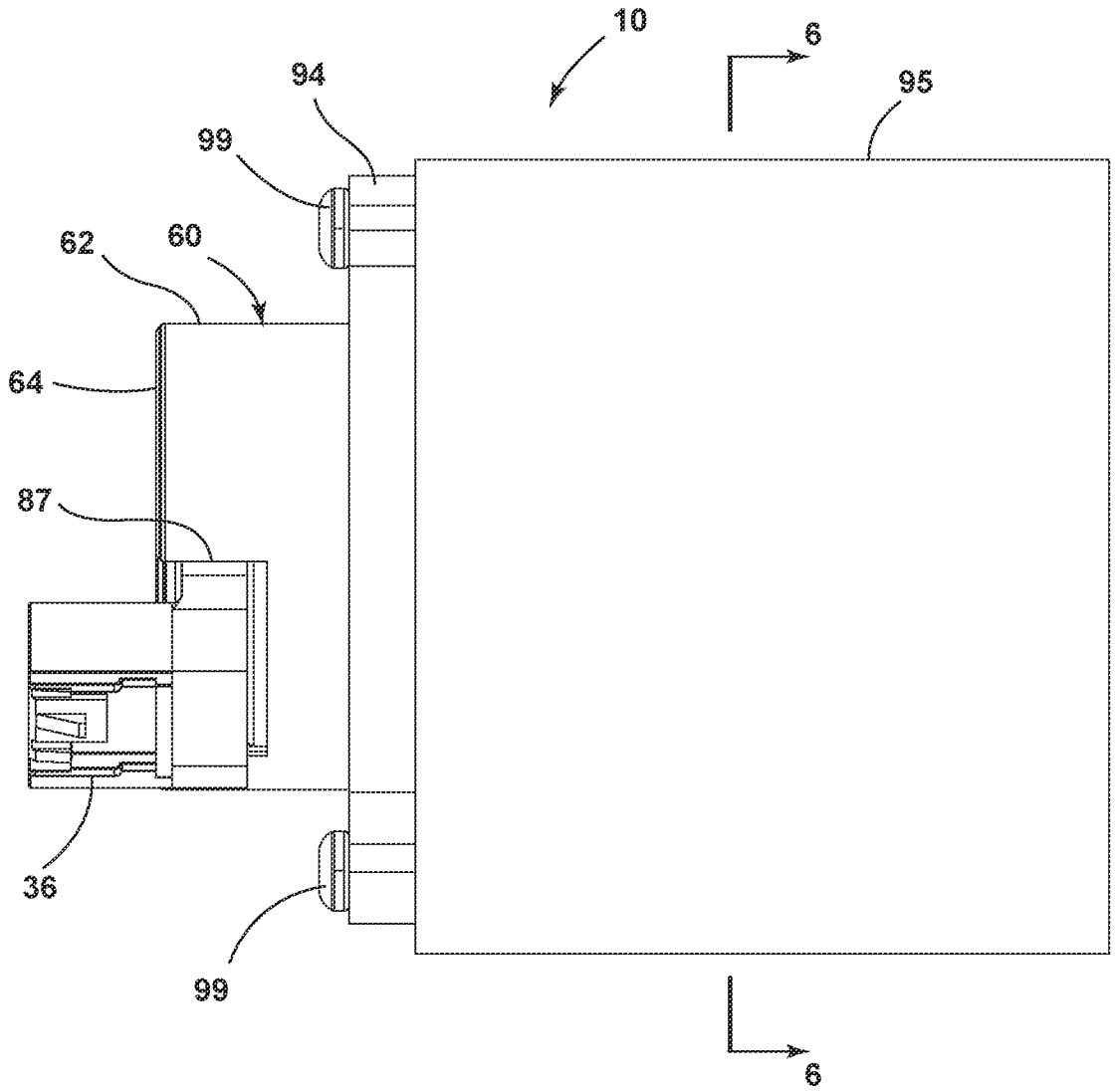
FIG. 2 is a side view of a positive displacement fluid pump in accordance with some embodiments of the disclosure.
Figure 3:
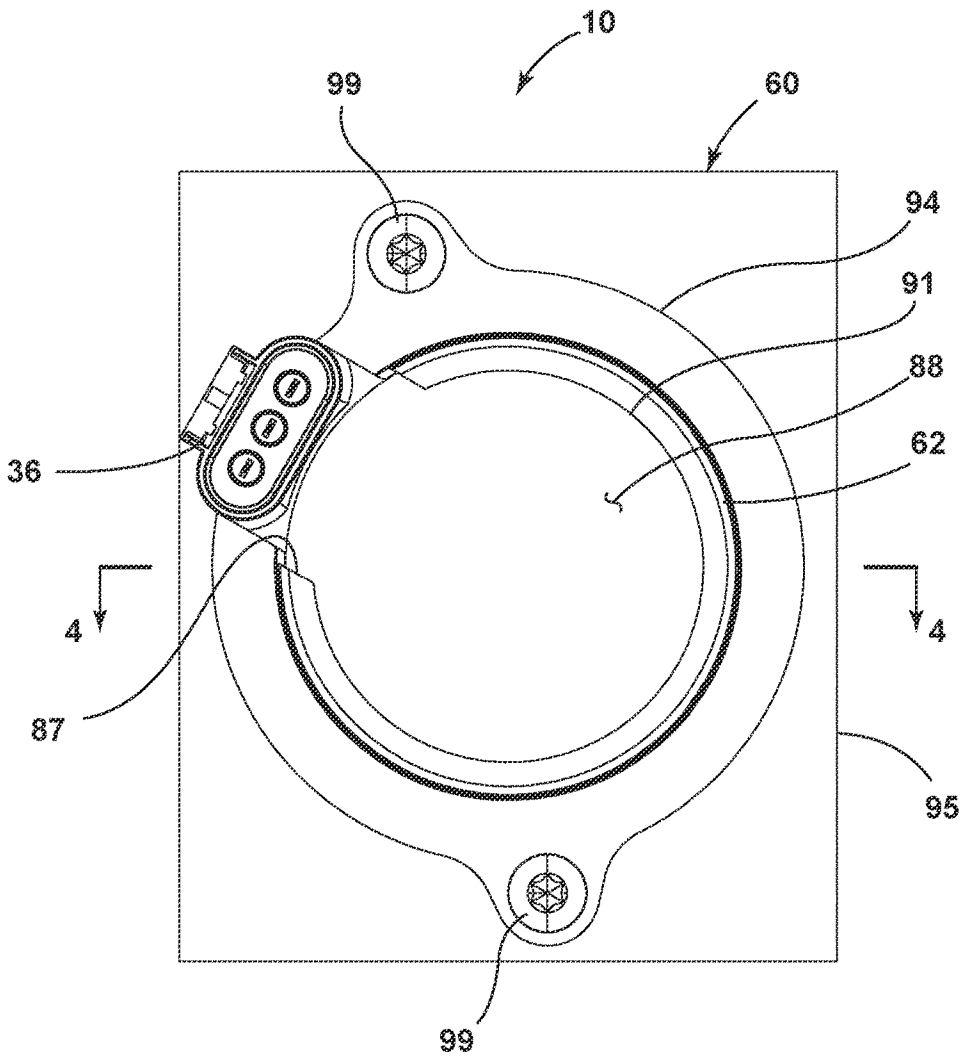
FIG. 3 is a plan view of the positive displacement fluid pump of FIG. 2.
Figure 4:
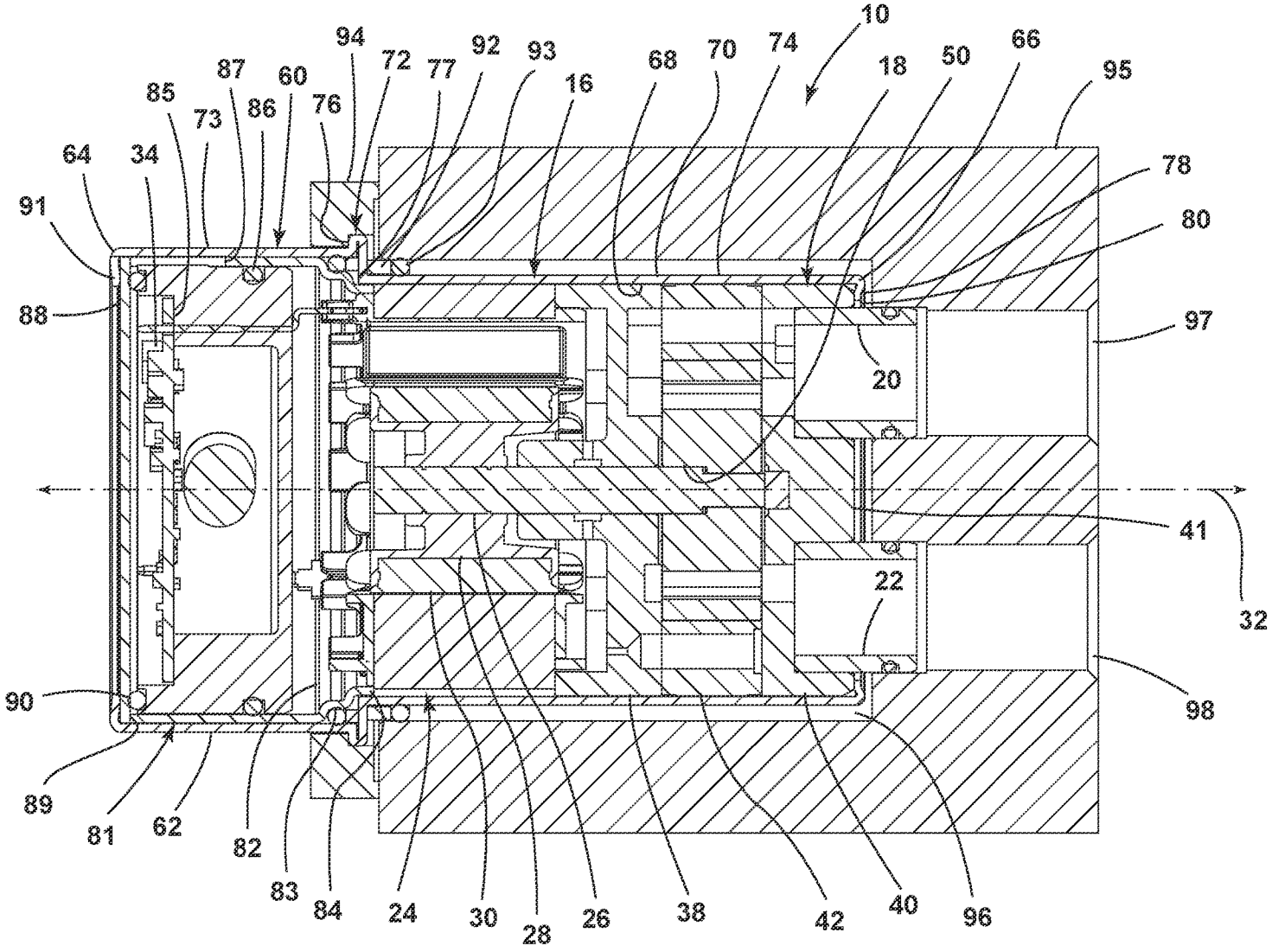
FIG. 4 is a cross-sectional view of the positive displacement fluid pump taken along the line 4-4 FIG. 3.
Figure 5:
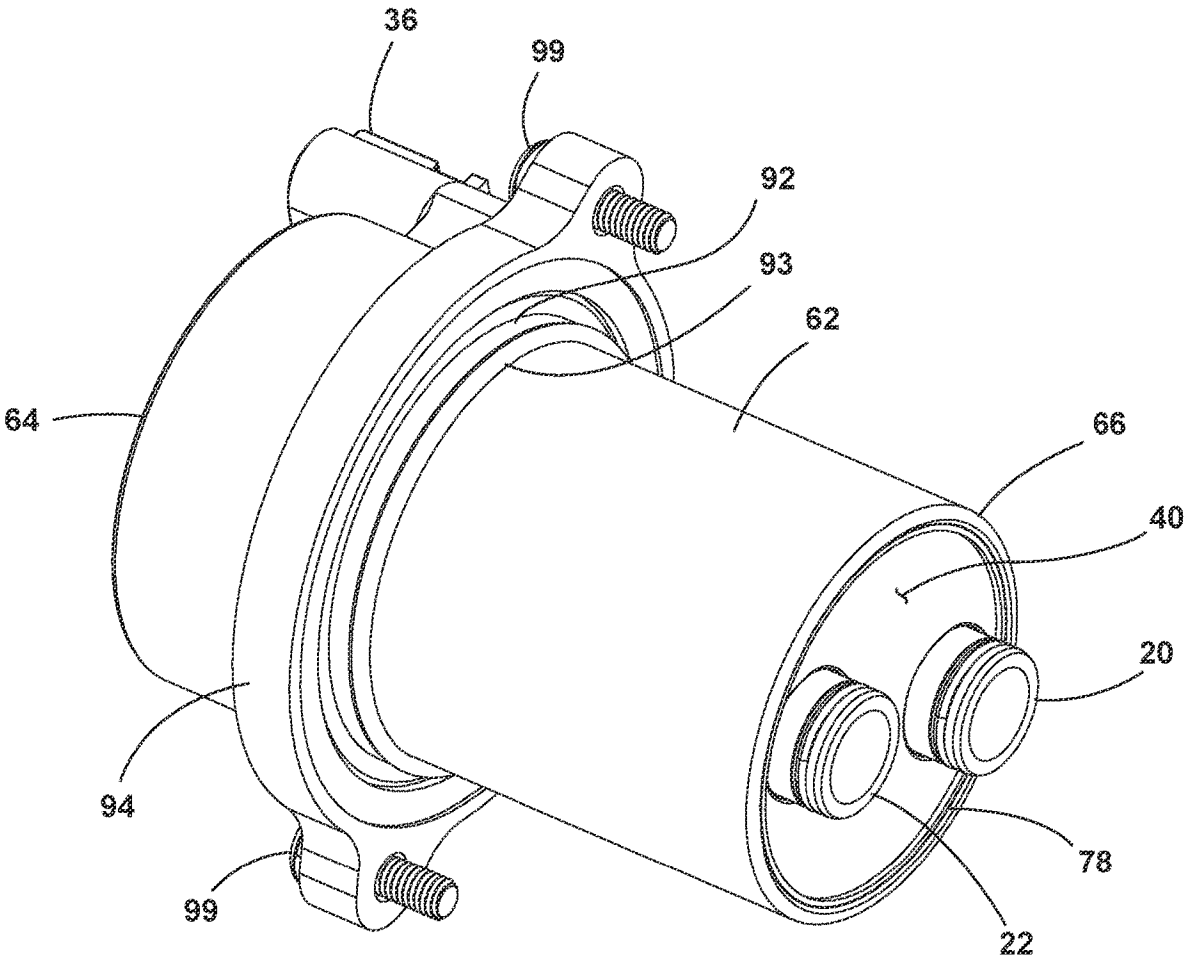
FIG. 5 is a perspective view of a shell of the positive displacement fluid pump of FIG. 2, removed from a housing.
Figure 6:
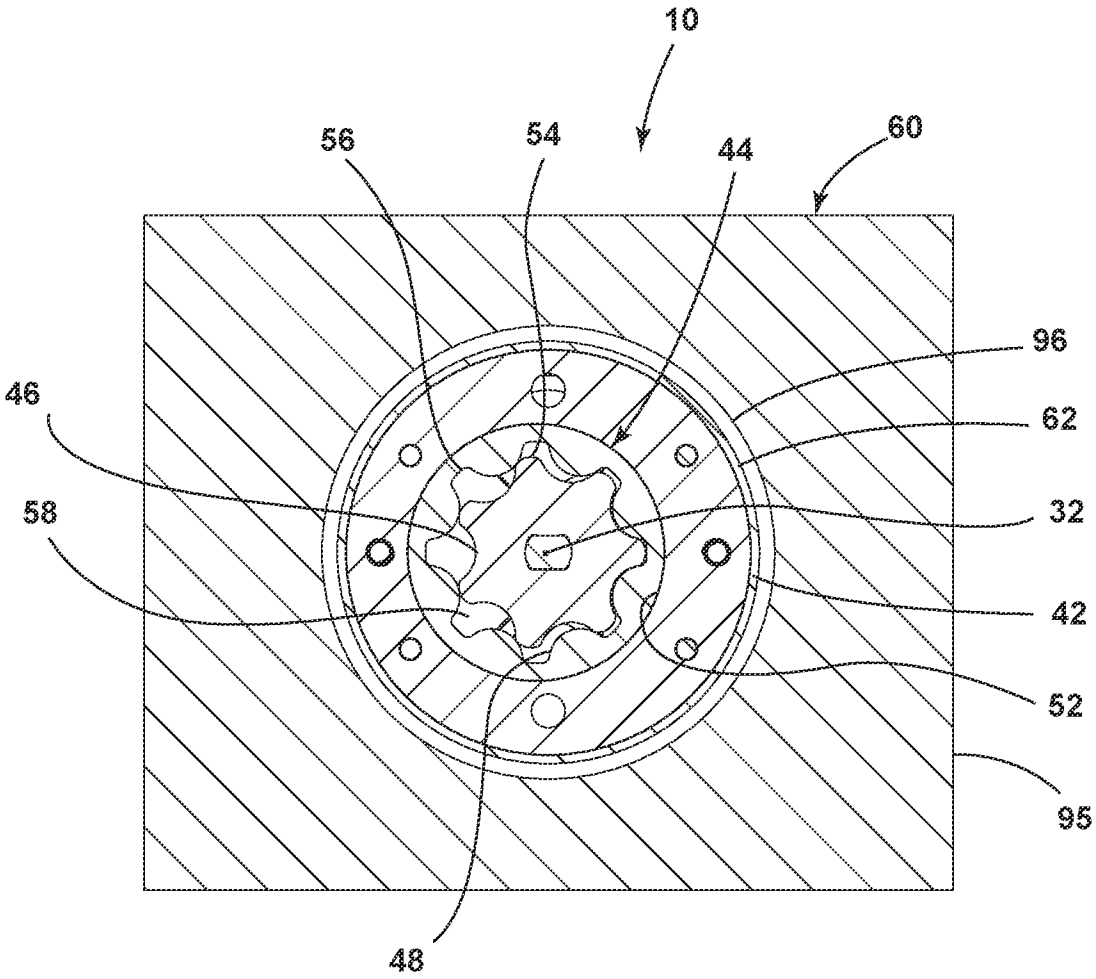
FIG. 6 is a cross-sectional view of the positive displacement fluid pump taken along the line 6-6 in FIG. 2.
Figure 7:
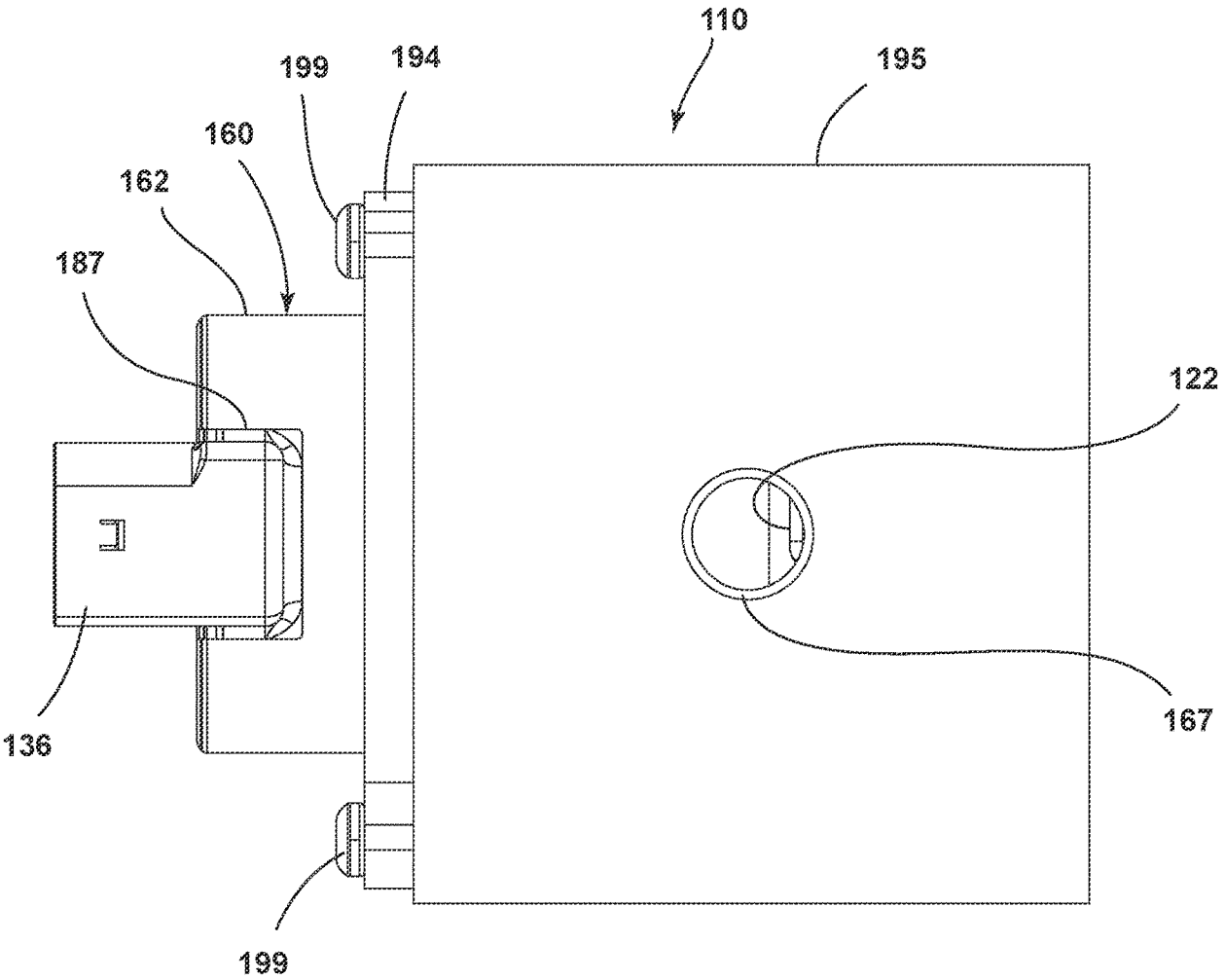
FIG. 7 is a side view of a positive displacement fluid pump in accordance with other embodiments of the disclosure.
Figure 8:
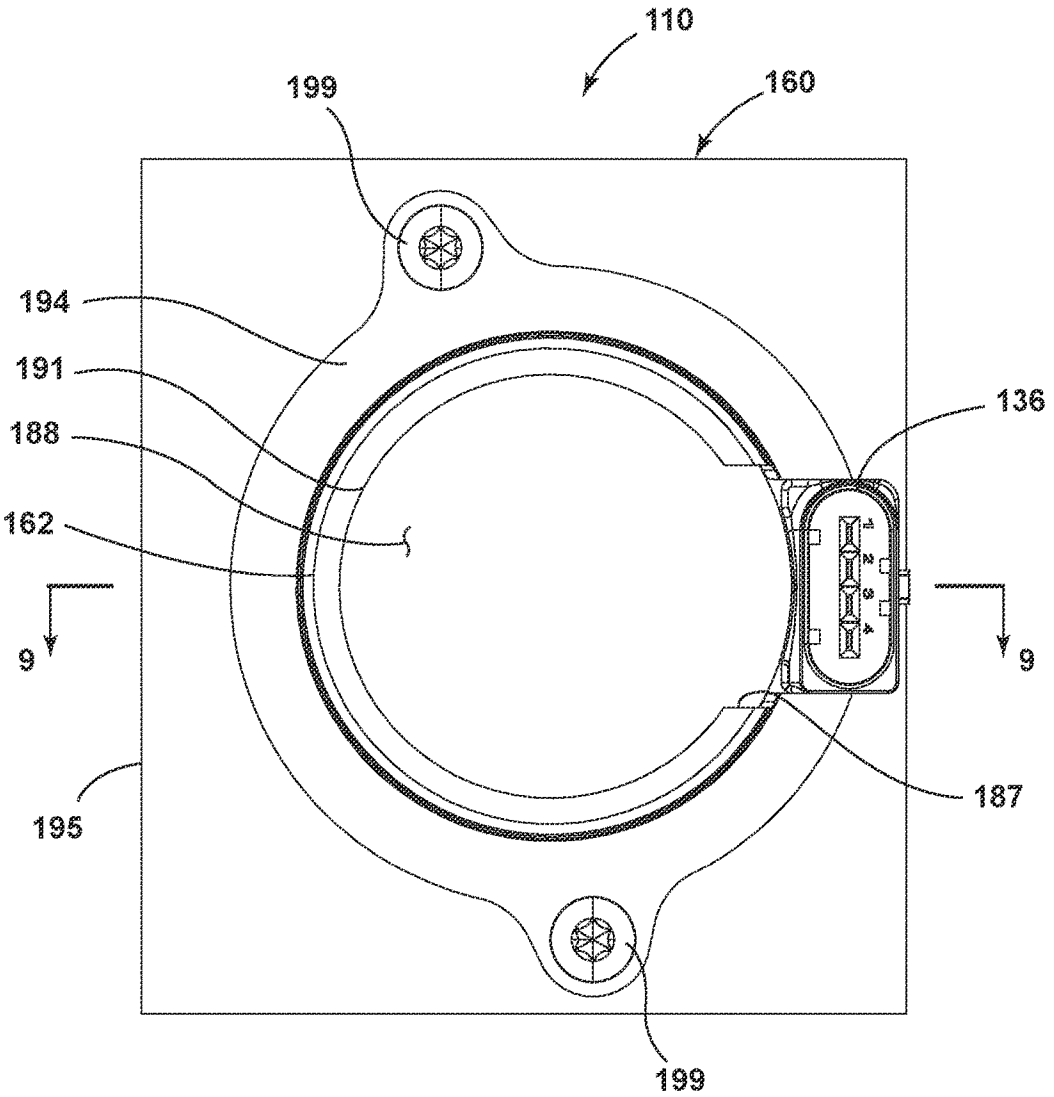
FIG. 8 is a plan view of the positive displacement fluid pump of FIG. 7.
Figure 9:
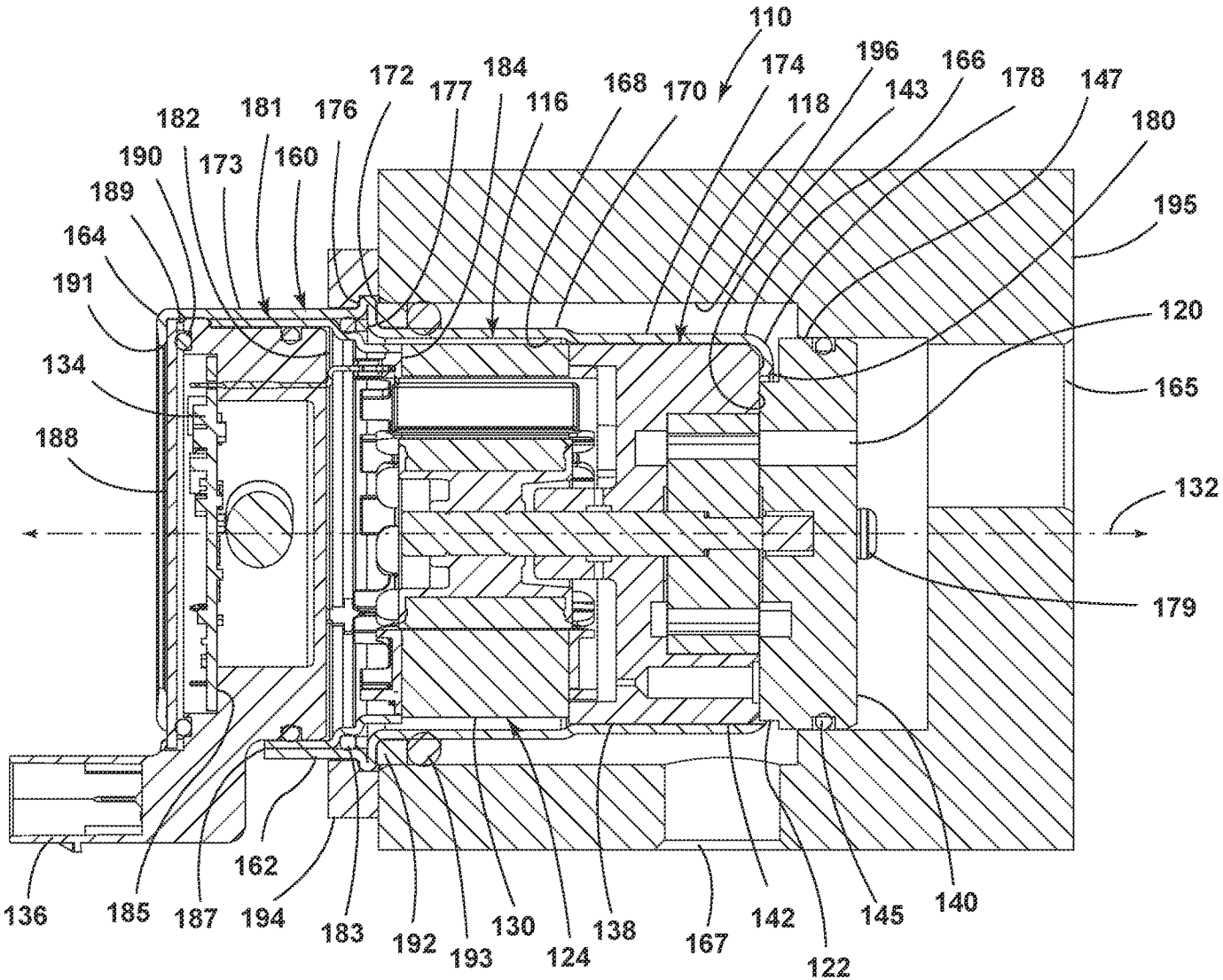
FIG. 9 is a cross-sectional view of the positive displacement fluid pump taken along the line 9-9 FIG. 8.
Figure 10:
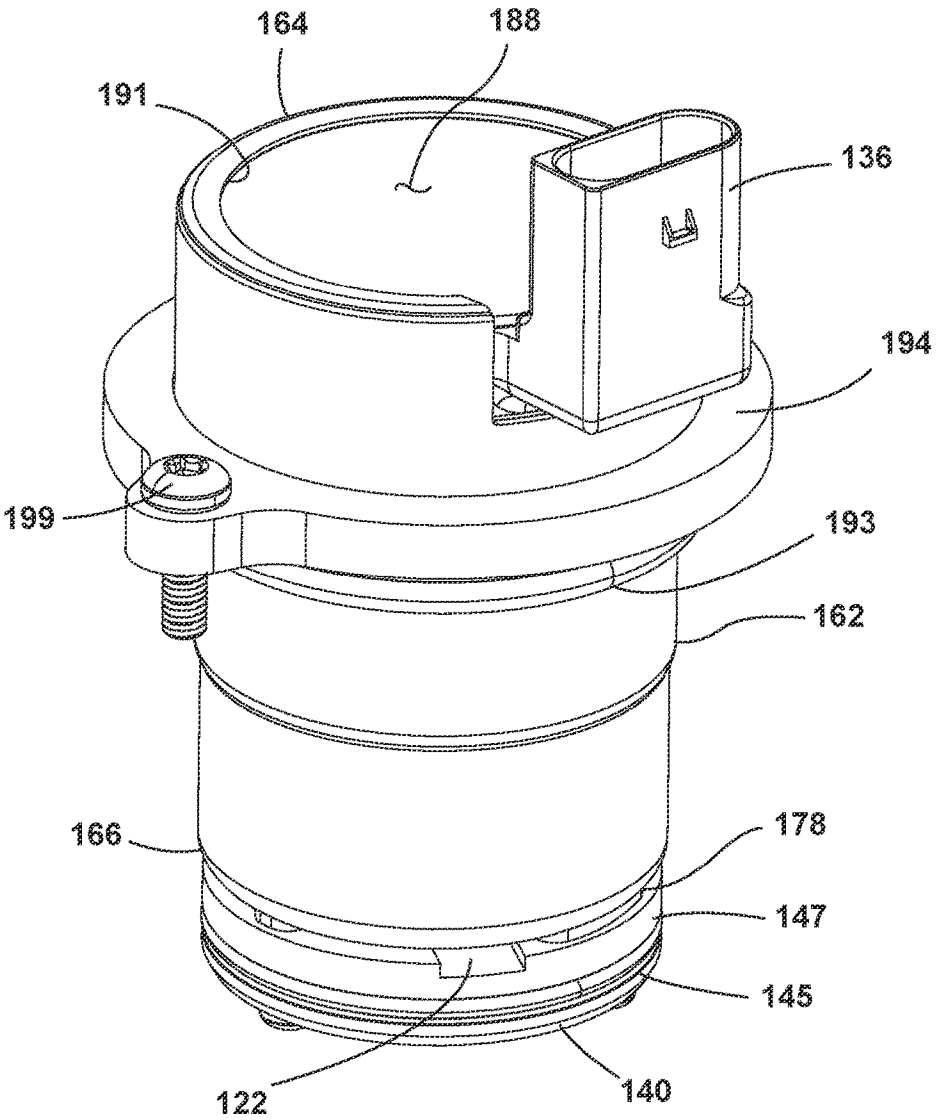
FIG. 10 is a perspective view of a shell of the positive displacement fluid pump of FIG. 7, removed from a housing.

A positive displacement fluid pump is provided. Referring to FIGS. 1-10, wherein like numerals indicate corresponding parts throughout the several views, the positive displacement fluid pump (also referred to as the fluid pump herein) is illustrated and generally designated as an oil pump 10 for pumping liquid oil from a reservoir 12 to an integrated drive module (IDM) of an electric or hybrid vehicle to cool and lubricate the internal working mechanisms of the IDM including the IDM drive motor 13 and gear box 14. While the fluid pump is illustrated as oil pump 10 for an IDM, it should be understood that the invention is not limited to an oil pump, but could also be applied to fluid pumps for pumping fluids other than oil, such as but not limited to fuel, and in other applications other than for an IDM. The oil pump 10 includes an encapsulation shell that provides the necessary rigidity and retention load requirements without the bolts, threads, and packaging space required for screwed/bolted together pump assemblies. Certain features of the oil pump 10 are functional, but can be implemented in different aesthetic configurations.

With reference to FIGS. 2-6, the oil pump 10 generally includes a motor section 16, and a pumping section 18 adjacent to motor section 16. Low pressure oil enters the pumping section 18 of the oil pump 10 via an inlet 20. A portion of the pumping section 18 is rotated by the motor section 16 as will be described in more detail below, and oil is pumped by the pumping section 18 and out of an outlet 22 of the oil pump 10 at a higher pressure than the inlet pressure.

Motor section 16 includes an electric motor 24 which may be, for example, an electronically commutated (EC) brushless motor. Electric motor 24 includes a drive shaft 26 extending therefrom into the pumping section 18. A permanent magnet rotor 28 is attached at an opposite end of the shaft 26, and the rotor 28 is surrounded by a stator 30. Shaft 26 rotates about a first axis 32 when an electric current is applied to the stator 30 of the electric motor 24. The electric motor 24 is connected to an internal controller 34 such as a printed circuit board, which in turn is connected a supply of power and/or an external controller by via a wire harness connector 36. Alternatively, the pump may not include an internal controller, and all control of the pump may be provided external to the pump. Electric motors and their operation are well known, consequently, electric motor 24 will not be discussed further herein.

By way of non-limiting example, the pumping section 18 includes an internal plate 38, an external plate 40, a pumping ring 42 sandwiched between the internal plate 38 and the external plate 40, and a pumping arrangement 44 rotatably coupled to the drive shaft 26. The pumping arrangement 44 is a gerotor, and the pumping arrangement 44 thus includes a rotating drive element that is illustrated as an inner gear rotor 46. The pumping arrangement 44 is also illustrated as including an outer gear rotor 48 that is a rotating driven element. Collectively, inner gear rotor 46 and outer gear rotor 48 will be referred to herein as pumping arrangement 44. The external plate 40 is disposed at an end of pumping section 18 that is distal from motor section 16 while internal plate 38 is disposed at an end of pumping section 18 that is proximal to the motor section 16. The drive shaft 26 extends through a central bore 50 in the internal plate 38 and is connected to the pumping arrangement 44. Pumping arrangement 44 is rotatably disposed within a circular gear rotor bore 52 formed within the pumping ring 42, and the pumping arrangement 44 is located axially between the internal plate 38 and the external plate 40. Gear rotor bore 52 is centered about a second axis (not shown) which is parallel and laterally offset relative to drive shaft axis 32. In this manner, the pumping ring 42 is in the form of an eccentric ring. Gear rotor bore 52 is diametrically sized to allow the outer gear rotor 48 to rotate freely therein while substantially preventing radial movement of outer gear rotor 48. The inner gear rotor 46 includes a plurality of external teeth 54 on the outer perimeter thereof which engage complementary internal tooth recesses 56 of the outer gear rotor 48, thereby defining a plurality of variable volume pumping chambers 58 between the inner gear rotor 46 and the outer gear rotor 48 that increase and decrease in size to suck and pressurize fluid such as the oil pumped by the pump 10. It should be noted that only representative external teeth 54, internal tooth recesses 56 and pumping chambers 58 have been labeled in the drawings. As shown, the inner gear rotor 46 has seven external teeth 54 while the outer gear rotor 48 has eight internal tooth recesses 56; however, it should be understood that inner gear rotor 46 may have any number n external teeth 54 while outer gear rotor 48 has n+1 internal tooth recesses 56. While the oil pump 10 has been described by example as being a gerotor-type fluid pump, the oil pump may be another type of positive displacement pump such as an impeller-type pump or a vane-type pump, such that the rotating element of the pumping arrangement may take other forms which may include, by way of non-limiting example, an impeller.

In operation, electricity is applied to the electric motor 24 which causes pumping arrangement 44 to rotate via rotation of the drive shaft 26, thereby drawing oil in through inlet 20 into the pumping chambers 58 at an initial pressure which may be by way of non-limiting example only, 0 kPa. Rotation of pumping arrangement 44 further causes the volume of pumping chambers 58 to decrease as each pumping chamber 58 rotates from being in communication with the inlet 20 to being in communication with the outlet 22, thereby causing oil to be pressurized to a final pressure which is much greater than the initial pressure, and pumped from the inlet 20 to the outlet 22.

With continued reference to FIGS. 2-5, in some embodiments the oil pump 10 has a casing 60 including a unitary, single-piece, elongated shell 62 that surrounds and encapsulates the components of the pump 10. Preferably, the shell 62 is formed of metal, but alternatively the shell may be formed of a plastic material. The shell 62 has opposite first and second open ends 64, 66, respectively, and an inner surface 68 and opposite outer surface 70. The shell 62 is generally tubular with a circular cross-sectional shape and has a sidewall thickness (between the inner and outer surfaces 68, 70) that is small in comparison to a diameter of the shell 62. A circumferential bead 72 is formed in the outer surface 70 of the shell 62 and generally divides the shell 62 into a first portion 73 and a second portion 74. In the illustrated embodiment, the motor section 16 and pumping section 18 are located in the second portion 74, while the internal controller 34 is located in the first portion 73. However, it should be understood that the portion of the shell that each component is located is not particularly significant, and for example the motor section 16 could be located in the first portion 73. On the other hand, significantly the components of the fluid pump 10 including the motor section 16 and pumping section 18 (the internal plate 38, the pumping ring 42, and the external plate 40) are tightly held within the boundaries of the shell 62. The bead 72 of the shell 62 may be formed by stamping, bending, and/or folding the sidewall of the shell 62. The bead 72 includes and is defined at least in part by a radial protrusion 76. In some embodiments as shown, the bead may also define an internal shoulder 77 within the shell 62.

A lip 78 is formed at the second open end 66 of the shell 62. In the embodiment shown in FIGS. 2-5, the internal plate 38, the pumping ring 42, and the external plate 40 are all disposed within the shell 62, and the lip 78 engages an outer face 41 of the external plate 40. The lip 78 generally has a wavy or hooked shape and presents an annular foot 80 on which the outer face 41 of the external plate 40 may engage and deflect under a load as described in more detail below.

A sleeve 81 is received in the first open end 64 of the shell 62 and is generally disposed between the bead 72 and the first open end 64 in the first portion 73 of the shell 62. However, a portion of the sleeve 81 may extend beyond the bead 72. The sleeve 81 may have a diameter just smaller than the diameter of the first portion 73 of the shell 62 such that the sleeve snugly fits within and contacts the inner surface 68 of the shell 62. The inner end 82 of the sleeve 81 may also be contoured such that the inner end 82 does not contact the inner surface 68 of the shell 62, and the sleeve avoids the internal shoulder 77 formed by the bead 72. Instead, an O-ring 83 or similar may be disposed adjacent the internal shoulder 77 between the sleeve 81 and the inner surface 68 of the shell 62. The terminal annular edge 84 of the sleeve 81 may contact and engage the motor 24.

The internal controller 34 is received within the sleeve 81 and the open first end 64 of the shell 62. For example, the internal controller 34 may be installed on a raised, annular base 85 that fits within the sleeve 81. An O-ring 86 or similar maintains the disposition of the base 85 and the sleeve 81. The shell 62 may include a cutout portion 87 that accommodates the wire harness connector 36 that extends outwardly from the base 85 and to which a wire harness is connected to the fluid pump 10. A heat sink cap 88 is received in the first open end 64 of the shell 62 and engages the outer edge 89 of the sleeve 81. The heat sink cap 88 may be, for example, a circular disk having a diameter that corresponds to the outer diameter of the sleeve 81. An O-ring 90 or similar may also be placed between the heat sink cap 88 and the base 85 to maintain the seal between the heat sink cap 88 and the base 85. A crimp 91 is formed at the first open end 64 of the shell 62 by crimping the end 64. The crimp 91 contacts the heat sink cap 88 and retains the heat sink cap in the first open end 64 of the shell 62. Significantly, the axial crimp load travels from the heat sink cap 88 to the sleeve 81, the stator 30 of the motor 24, the internal plate 38, the pumping ring 42, and the external plate 40 to the lip 78. The crimp load path is thus essentially formed entirely of metal without any plastic or rubber. The axial crimp load deflects the annular foot 80 of the lip 78 and provides a force that holds the components of the pump in urged engagement.

An annular backup ring 92 and an O-ring 93 may be disposed around the outer surface 70 of the shell 62 adjacent the radial protrusion 76 of the bead 72. Further, a mounting ring 94 may surround the bead 72. The mounting ring 94 may be used to mount the shell 62 to a surface such as describe below. For example, the casing 60 may include a housing 95 having a recessed cavity 96. The shell 62 may be inserted into and received by the cavity 96. The housing 95 may also include a pair of through holes including an inlet opening 97 and an outlet opening 98 extending through the housing from the cavity 96. The inlet opening 97 and outlet opening 98 receive the inlet 20 and outlet 22 of the fluid pump 10, respectively. In this embodiment, the inlet opening 97 and outlet opening 98, and hence the inlet 20 and outlet 22 of the fluid pump 10, are arranged in an axial direction of the shell 62, which is parallel to the drive shaft axis 32. Hence, suction of fluid performed by the fluid pump 110 is in the axial direction, and likewise delivery of pressurized fluid from the pump is also in the axial direction. The mounting ring 94 is fastenable onto the housing 95 such as with two bolts 99 or similar that secure the shell 62 to the housing 95. The backup ring 92 and O-ring 93 provide a seal between the shell 62 and the cavity 96 of the housing 95.

The fluid pump 10 including the casing 60 is assembled and hence encapsulated as follows. The pumping section 18 of the fluid pump 10 is inserted into the shell 62 through the first open end 64 and is disposed adjacent the lip 78. More specifically, the external plate 40, the pumping ring 42, and the internal plate 40 in that order are inserted into the shell 62 such that the external plate 40 contacts the lip 78. Next, the motor section 16 including the electric motor 24 is inserted into the shell 62 through the first open end 64 and disposed adjacent the pumping section 18. Subsequently, the sleeve 81 is inserted into the shell 62 through the first open end 64, and the annular base 85 and associated controller 34 are inserted into the sleeve 81 through the first open end 64 of the shell 62. After placement of the controller 34 into the shell/sleeve, the heat sink cap 88 is inserted into the first open end 64 and in contact with the outer edge 89 of the sleeve 81. The first open end 64 of the shell 62 is then crimped to form the crimp 91 that retains the pump 10 in the shell and exerts a retention load on the lip 78 of the shell through the components of the assembly, including the heat sink cap 88, the sleeve 81, the motor section 16, and the pumping section 18. The shell 62 may then be placed into the cavity 96 of the housing 95 and secured to the housing with bolts 99 inserted through the mounting ring 94.

With reference now to FIGS. 7-10, in other embodiments the oil pump 110 has a casing 160 including a unitary, single-piece, elongated shell 162 that surrounds and encapsulates the components of the pump. The shell 162 has opposite first and second open ends 164, 166, respectively, and an inner surface 168 and opposite outer surface 170. The shell 162 is generally tubular with a circular cross-sectional shape and has a sidewall thickness (between the inner and outer surfaces 168, 170) that is small in comparison to a diameter of the shell. Components of the fluid pump 110 including the motor section 116 and parts of the pumping section 118 (the internal plate 138 and the pumping ring 142) are tightly held within the boundaries of the shell 162. A circumferential bead 172 is formed in the outer surface 170 of the shell 162 and generally divides the shell 162 into a first portion 173 and a second portion 174. The bead 172 of the shell 162 may be formed by stamping, bending, and/or folding the sidewall of the shell 162. The bead 172 includes and is defined at least in part by a radial protrusion 176. In some embodiments as shown, the bead 172 may also define an internal shoulder 177 within the shell 162.

A lip 178 is formed at the second open end 166 of the shell 162. In the embodiment shown in FIGS. 7-10, the internal plate 138 and the pumping ring 142 are disposed within the shell 162, and the lip 178 engages an outer face 143 of the pumping ring 142, while the external plate 140 is disposed outside of the shell 162 and secured to the pumping ring 142 by a fastener such as a bolt 179 or similar. The lip 178 generally has a wavy or hooked shape and presents an annular foot 180 on which the outer face 143 of the pumping ring 142 may engage and deflect under a load as described herein. An O-ring 145 is disposed around and thereby encircles a sidewall 147 of the external plate 140.

A sleeve 181 is received in the first open end 164 of the shell 162 and is generally disposed between the bead 172 and the first open end 164 in the first portion 173 of the shell 162. However, a portion of the sleeve 181 may extend beyond the bead 172. The sleeve 181 may have a diameter just smaller than the diameter of the first portion 173 of the shell 162 such that the sleeve 181 snugly fits within and contacts the inner surface 168 of the shell 162. The inner end 182 of the sleeve 181 may also be contoured such that the inner end does not contact the inner surface 168 of the shell 162, and the sleeve 181 avoids the internal shoulder 177 formed by the bead 172. Instead, an O-ring 183 or similar may be disposed adjacent the internal shoulder 177 between the sleeve 181 and the inner surface 168 of the shell 162. The terminal annular edge 184 of the sleeve 181 may contact and engage the motor 124.

The internal controller 134 is received within the sleeve 181 and the open first end 164 of the shell 162. For example, the internal controller 134 may be installed on a raised, annular base 185 that fits within the sleeve 181. An O-ring 186 or similar maintains the disposition of the base 185 and the sleeve 181. The shell 162 may include a cutout portion 187 that accommodates the wire harness connector 136 that extends outwardly from the base 185 and to which a wire harness is connected to the fluid pump 110. A heat sink cap 188 is received in the first open end 164 of the shell 162 and engages the outer edge 189 of the sleeve 181. The heat sink cap 188 may be, for example, a circular disk having a diameter that corresponds to the outer diameter of the sleeve. An O-ring 190 or similar may also be placed between the heat sink cap 188 and the base 185 to maintain the seal between the heat sink cap and the base. A crimp 191 is formed at the first open end 164 of the shell 162. The crimp 191 contacts the heat sink cap 188 and retains the heat sink cap in the first open end 164 of the shell 162. The axial crimp load travels from the heat sink cap 188 to the sleeve 181, the stator 130 of the motor 124, the internal plate 138, and the pumping ring 142 to the lip 178. The crimp load path is thus essentially all metal without any plastic or rubber. The axial crimp load deflects the annular foot 180 of the lip 178.

An annular backup ring 192 and an O-ring 193 may be disposed around the outer surface 170 of the shell 162 adjacent the radial protrusion 176 of the bead 172. Further, a mounting ring 194 may surround the bead 172. The mounting ring 194 may be used to mount the shell 162 to a surface. For example, the casing 160 may include a housing 195 having a recessed cavity 196. The shell 162 may be inserted into and received by the cavity 196. The O-ring 145 on the sidewall 147 of the external plate 140 provides a seal between the external plate 140 and the wall of the cavity 196 of the housing 195. The mounting ring 194 is fastenable onto the housing 195 such as with two bolts 199 or similar that secure the shell 162 to the housing 195. The backup ring 192 and O-ring 193 provide a seal between the shell 162 and the cavity 196 of the housing 195. The housing 195 may also include a pair of through holes including an inlet opening 165 and an outlet opening 167 extending through the housing 195 from the cavity 196. The inlet opening 165 is aligned with and in fluid communication with the inlet 120 of the fluid pump 110, and the inlet opening 165 of the housing 195 is arranged in an axial direction of the shell 162 and parallel to the drive shaft axis 132. In contrast, the outlet opening 167 of the housing 195 is arranged in a radial direction of the shell 162 (and radially relative to the drive shaft axis 132), and the outlet 122 of the pump 110 is formed in the sidewall 147 of the external plate 140, the outlet 122 being in fluid communication with the outlet opening 167 of the housing 195. Hence, suction of fluid performed by the fluid pump 110 is in the axial direction, whereas delivery of pressurized fluid from the pump is in the radial direction.

The fluid pump 110 including the casing 160 is assembled and hence encapsulated as follows. A portion of the pumping section 118 of the fluid pump 10 is inserted into the shell through the first open end 164 and is disposed adjacent the lip 178. More specifically, the pumping ring 142 and the internal plate 138 are inserted into the shell 162 in that order such that the pumping ring 142 contacts the lip 178. Next, the motor section 116 including the electric motor 124 is inserted into the shell 162 through the first open end 164 and disposed adjacent the pumping section 118. Subsequently, the sleeve 181 is inserted into the shell 162 through the first open end 164, and the annular base 185 and associated controller 134 are inserted into the sleeve 181 through the first open end 164. After placement of the controller 134 into the shell/sleeve, the heat sink cap 188 is placed into the first open end 164 and in contact with the outer edge 189 of the sleeve 181. The first open end 164 of the shell 162 is then crimped to form the crimp 191 that retains the pump 110 in the shell 162 and exerts a retention load on the lip 178 of the shell 162 through the components of the assembly, including the heat sink cap 188, the sleeve 181, the motor section 116, and the pumping section 118. Additionally, the external plate 140 is subsequently mounted onto the pumping ring 142 using bolt 179. In this disposition, the external plate 140 is on the outside of the shell 162 adjacent the lip 178. The shell 162 may then be placed into the cavity 196 of the housing 195 and secured to the housing with bolts 199 inserted through the mounting ring 194.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements by ordinal terms, for example "first," "second," and "third," are used for clarity, and are not to be construed as limiting the order in which the claim elements appear. Any reference to claim elements in the singular, for example, using the articles "a," "an," "the" or "said," is not to be construed as limiting the element to the singular.

The invention claimed is:

1. A casing for a fluid pump, the casing comprising:
a unitary, single-piece, elongated shell having opposite first and second open ends;
a circumferential bead formed in the shell, the bead including a radial protrusion;
a sleeve received in the first open end of the shell, the sleeve being disposed between the bead and the first open end;
a heat sink cap received in the first open end and engaging the sleeve;
the shell including a crimp formed at the first open end, the crimp contacting the heat sink cap and retaining the heat sink cap in the first open end; and
the shell including a lip formed at the second open end;
wherein the fluid pump includes a motor section and a pumping section, and the motor section and at least a part of the pumping section are encapsulated within the shell between the lip and the crimp.

2. The casing of claim 1, wherein the shell is formed of metal.

3. The casing of claim 1, wherein the shell is generally tubular in shape.

4. The casing of claim 1, further including:
a housing including a cavity;
the shell being received in the cavity; and
a mounting ring surrounding the bead of the shell, wherein the mounting ring is fastened onto the housing to secure the shell therein.

5. The casing of claim 4, further including an O-ring disposed around an outer surface of the shell adjacent the bead, the O-ring sealing the casing between the cavity and the shell.

6. The casing of claim 1, wherein the heat sink cap is a circular disk.

7. A fluid pump comprising:
a motor section;
a pumping section driven by the motor section;
a unitary, single-piece, elongated shell having opposite first and second open ends;
a circumferential bead formed in the shell, the bead including a radial protrusion;
a sleeve received in the first open end of the shell, the sleeve being disposed between the bead and the first open end;
a heat sink cap received in the first open end and engaging the sleeve;

the shell including a crimp formed at the first open end, the crimp contacting the heat sink cap and retaining the heat sink cap in the first open end; and the shell including a lip formed at the second open end;

the pumping section being disposed at least partially within the shell adjacent the lip;

the motor section being disposed within the shell adjacent to the pumping section; and a controller disposed within the sleeve adjacent the heat sink cap.

8. The fluid pump of claim 7, wherein the sleeve contacts the motor section.

9. The fluid pump of claim 7, wherein the housing includes an inlet opening and an outlet opening.

10. The fluid pump of claim 9, wherein the inlet opening and the outlet opening are arranged in an axial direction of the shell.

11. The fluid pump of claim 9, wherein the inlet opening is arranged in an axial direction of the shell, and the outlet opening is arranged in a radial direction of the shell.

12. The fluid pump of claim 7, wherein the pumping section includes a pumping ring sandwiched between an external plate and an internal plate.

13. The fluid pump of claim 12, wherein the internal plate, the pumping ring, and the external plate are disposed within the shell, and the lip of the shell engages an outer face of the external plate.

14. The fluid pump of claim 12, wherein the internal plate and pumping ring are disposed within the shell, the lip of the shell engages an outer face of the pumping ring, and the external plate is disposed outside of the shell adjacent the second open end of the shell.

15. The fluid pump of claim 14, including an O-ring encircling a sidewall of the external plate.

16. A method of encapsulating a fluid pump, the method comprising:

providing the casing of claim 1;

providing a fluid pump that includes a pumping section, a motor section, and a controller;

inserting at least a portion of the pumping section into the shell adjacent the lip of the shell;

inserting the motor section into the shell adjacent the pumping section;

inserting the controller within the sleeve in the first open end of the shell;

placing the heat sink cap on the sleeve adjacent the first open end of the shell; and crimping an edge of the first open end of the shell to form the crimp, wherein a load is exerted on the sleeve by the heat sink cap and transferred to the lip at the second open end of the shell via the motor section and the pumping section within the sleeve.

17. The method of claim 16, wherein:

the casing further includes a mounting ring surrounding the bead of the shell, and a housing including a cavity; and the method further includes the steps of:

inserting the shell into the cavity of the housing; and fastening the mounting ring onto the housing to secure the shell therein.

* * * * *